US007867567B2

(12) United States Patent
Hasegawa et al.

(10) Patent No.: US 7,867,567 B2
(45) Date of Patent: Jan. 11, 2011

(54) COATING METHOD OF COATING SOLUTION

(75) Inventors: Youichi Hasegawa, Fujinomiya (JP); Tomonari Ogawa, Fujinomiya (JP); Kazuhiko Nojo, Fujinomiya (JP)

(73) Assignee: Fujifilm Corporation, Tokyo (JP)

( * ) Notice: Subject to any disclaimer, the term of this patent is extended or adjusted under 35 U.S.C. 154(b) by 904 days.

(21) Appl. No.: 11/236,605

(22) Filed: Sep. 28, 2005

(65) Prior Publication Data

US 2006/0068114 A1 Mar. 30, 2006

(30) Foreign Application Priority Data

Sep. 30, 2004 (JP) ..... 2004-286025

(51) Int. Cl.

| | |
|---|---|
| ***B05D 3/12*** | (2006.01) |
| *B05B 13/02* | (2006.01) |
| *B05C 3/02* | (2006.01) |
| *B05C 3/12* | (2006.01) |

(52) U.S. Cl. ..... 427/356; 118/325; 118/410; 118/411; 118/419; 427/355

(58) Field of Classification Search ..... 427/356
See application file for complete search history.

(56) References Cited

FOREIGN PATENT DOCUMENTS

| | | |
|---|---|---|
| JP | 2003-200097 | 7/2003 |
| JP | 2003-211052 | 7/2003 |
| JP | 2003211052 A * | 7/2003 |
| JP | 2003-236434 | 8/2003 |
| JP | 2003-285343 | 10/2003 |
| JP | 2004-141806 | 5/2004 |
| WO | WO 95/29764 | 11/1995 |

OTHER PUBLICATIONS

Carvalho, Marcio et al., "Low-Flow Limit in Slot Coating: Theory and Experiments," AIChE Journal, vol. 46, No. 10, pp. 1907-1917 (Oct. 2000).*

Japanese Patent Office issued a Japanese Office Action dated Aug. 4, 2009, Application No. 2004-286025.

* cited by examiner

*Primary Examiner*—Michael Kornakov
*Assistant Examiner*—Alexander Weddle
(74) *Attorney, Agent, or Firm*—Young & Thompson

(57) ABSTRACT

In an aspect of the coating method according to the present invention, the lower limit decompression degree $P_{S1}$ at which a seam trouble occurs is obtained from the formula of the viscocapillary model. According to the aspect of the present invention, coating is performed by setting the $P_b$ so as to satisfy $P_{S1}<P_0-P_b\leqq P_{S1}+0.2$, and therefore, stepped unevenness can be effectively suppressed so that a seam trouble does not occur. It goes without saying that the aspect of the present invention can be applied to high viscosity/thick film coating, but it is effective especially in the case where a coating solution with low viscosity (for example, 0.005 Pa·s or lower) is coated to be an ultra-thin film (for example, 10 μm or less in the wet film thickness) where stepped unevenness easily occurs.

2 Claims, 2 Drawing Sheets

COATING METHOD OF COATING SOLUTION

BACKGROUND OF THE INVENTION

1. Field of the Invention

The present invention relates to a coating method of a coating solution, and particularly relates to a coating method of a coating solution for performing ultra thin film coating of a coating solution with low viscosity by using a slot die.

2. Description of the Related Art

In a coating method for coating a coating solution onto a web while being supported by a backup roller by using a slot die having a decompression chamber, stepped unevenness where film thickness of the coating film has stepped unevenness in a traveling direction of a web occurs due to disturbance elements such as feeding unevenness of the web, decompression variation, pulsation at the time of delivery of the coating solution, pulsation of the slot die and the backup roller, flatness of the web (degree of irregularities) and the like.

Incidentally, high functional thin-layer films for antireflection, glare protection, enlargement of a view angle and the like which are used in a liquid crystal display and the like are manufactured by coating a web with a coating solution having these functions. In order to allow the high functional thin-layer film to exhibit desired functions with high accuracy, in recent years, it is required to coat an ultra-thin film (for example, wet film thickness of 10 μm or less) with low viscosity (for example, 0.005 Pa·s or lower) as compared with the conventional coating solution. Since a leveling effect of the coating solution after coated cannot be expected in the case of low viscosity/ultra-thin film coating, it becomes important how the stepped unevenness is suppressed during coating. For this reason, improvement has been made for suppression of the above described disturbances themselves and a bead shape having high resistance against the disturbances.

As for the conventional measures for suppression of stepped unevenness, it is proposed to set the decompression degree at −200 to −300 Pa in Japanese Patent Application Laid-Open No. 2003-285343. Besides, in National Publication of International Patent Application No. 9-511682 and Japanese Patent Application Laid-Open No. 2003-211052, it is proposed to contour a lip tip end of a slot die into an overbite shape. Besides, in Japanese Patent Application Laid-Open No. 2003-236434, it is proposed to increase a clearance of side/back plates to relieve variation of the decompression degree in the decompression chamber.

SUMMARY OF THE INVENTION

However, the conventional measures for suppressing the stepped unevenness is insufficient as the stepped unevenness suppression measure in the case of the above described low viscosity/ultra-thin film coating, and a further measure is desired.

The present invention is made in view of the above circumstances, and an object of the present invention is to provide a coating method of a coating solution which can effectively suppress occurrence of stepped unevenness even in the case of low viscosity/ultra-thin film coating.

The inventor has obtained the following findings as a result of earnestly studying a decompression degree $P_b$ at a web upstream side of a bead formed by cross-linking a coating solution between a web which continuously travels while being supported by a backup roller and a lip land of a slot die in a case of coating a coating solution with low viscosity (for example, 0.005 Pa·s or lower) to be a ultra-thin film (for example, 10 μm or less in wet film thickness) with the slot die.

(1) When the decompression degree $P_b$ at the web upstream side with respect to the pressure $P_0$ (usually the atmospheric pressure) at the web downstream side of the bead was made extremely small under the condition where stepped unevenness is easily formed by vibrating the slot die, a remarkable suppression effect of the stepped unevenness was seen as compared with the case where the decompression degree $P_b$ was large. Namely, by making the decompression degree $P_b$ extremely small, it is possible to form the bead having resistance against a disturbance.

(2) When the decompression degree $P_b$ is made too small and becomes less then the lower limit decompression degree $P_{S1}$ on the other hand, a seam trouble occurs to the coating film surface as a result that air accompanying the web enters a space between the bead and the web.

(3) It was found out that in $P_{S1}<P_0-P_b\leqq P_{S1}+0.2$, which is an extremely narrow range of the decompression degree $P_b$, the above described contradicting phenomena did not occur and the stepped unevenness was able to be effectively suppressed without occurrence of a seam trouble. The present invention is made based on the above described findings.

In order to achieve the above-described object, a first aspect of the present invention is, in a coating method of a coating solution for discharging a coating solution from a slot tip end of a slot die to which a lip land is closely disposed to a web surface which continuously travels while being supported by a backup roller to form a bead between the slot tip end and the web, and coating the coating solution on the web surface while decompressing a web upstream side of the bead, comprising the step of:

setting $P_b$ so that a decompression degree $P_0$-$P_b$ (kPa) at the web upstream side with respect to a web downstream side of the bead satisfies the following formula:

$$P_{S1}<P_0-P_b\leqq P_{S1}+0.2$$

where $$P_{S1} = 1.34(\mu v/\sigma_1)^{2/3}(\sigma_1/h) - \frac{\sigma_4(1+\cos\theta)}{d} + \frac{12\mu v l_1\{(d/2)-h\}}{d^3}$$

$P_0$: pressure at the web downstream side of the bead $P_b$: pressure at the web upstream side of the bead μ: viscosity of the coating solution (Pa·s)

v: coating speed (m/min)

$\sigma_1$: surface tension of a downstream side bead (N/m)

$\sigma_4$: surface tension of an upstream side bead (N/m)

h: wet film thickness of the coating solution coated on the web (m)

d: a coating gap between the lip land and the web (m)

$l_1$: length in a web traveling direction of a downstream side lip land (m), and θ: a contact angle of the web and the bead; and performing coating.

The first aspect is the case where the lower limit decompression degree $P_{S1}$ at which a seam trouble occurs is obtained from the formula of the viscocapillary model (see page 401, "COATING" by Converting Technical Institute). According to the first aspect, coating is performed by setting the $P_b$ so as to satisfy $P_{S1}<P_0-P_b\leqq P_{S1}+0.2$, and therefore, stepped unevenness can be effectively suppressed so that a seam trouble does not occur. It goes without saying that the first aspect can be applied to high viscosity/thick film coating, but it is effective especially in the case where a coating solution with low viscosity (for example, 0.005 Pa·s or lower) is coated to be an ultra-thin film (for example, 10 μm or less in the wet film thickness) where stepped unevenness easily occurs.

Here, $P_0$ is the pressure at the web downstream side of the bead, and usually the atmospheric pressure, and therefore, the negative pressure of the $P_b$ with respect to the atmospheric pressure becomes the decompression degree $P_0-P_b$ at the web upstream side with respect to the web downstream side of the bead.

In order to achieve the above described object, a second aspect of the present invention is, in a coating method of a coating solution for discharging a coating solution from a slot tip end of a slot die to which a lip land is closely disposed to a web surface which continuously travels while being supported by a backup roller to form a bead between the slot tip end and the web, and coating the coating solution on the web surface while decompressing a web upstream side of the bead, comprising the steps of:

previously obtaining a lower limit decompression degree $P_{S1}$ (kPa) at which a seam trouble begins to occur to a coating solution film surface coated on the web when the decompression degree $P_b$ (kPa) at the web upstream side of the bead is made smaller by a preliminary operation;

setting the $P_b$ so that a decompression degree $P_0-P_b$ (kPa) at the web upstream side with respect to a web downstream side of the bead satisfies the following formula in a full-scale operation:

$$P_{S1}<P_0-P_b\leqq P_{S1}+0.2$$

where $P_0$: pressure at the web downstream side of the bead $P_b$: pressure at the web upstream side of the bead; and performing coating.

The second aspect is the case where the lower limit decompression degree $P_{S1}$ at which a seam trouble occurs is obtained by the preliminary operation (also including a preliminary test by experimental equipment and the like without being limited to the preliminary operation by actual equipment). According to the second aspect, coating is performed by setting the $P_b$ to satisfy $P_{S1}<P_0-P_b\leqq P_{S1}+0.2$, and therefore stepped unevenness can be effectively suppressed so that a seam trouble does not occur.

A third aspect of the present invention is in the first or the second aspect, wherein a coating gap d of the lip land and the web is set so as to satisfy the following formula:

$$d=(2h/1.34)(\mu w/\sigma_1)^{-2/3}\times\alpha$$

$$0.25\leqq\alpha<1$$

This is made based on additional findings of the inventor that narrowing the coating gap d being a space between the lip land and the web too much causes stepped unevenness, and by setting the coating gap d to satisfy the above described formula, occurrence of the stepped unevenness can be suppressed more effectively.

A fourth aspect of the present invention is, in any one of the first to the third aspects, wherein viscosity of the coating solution is 0.005 Pa·s or lower.

This is because stepped unevenness easily occurs in low viscosity coating with the viscosity of the coating solution of 0.005 Pa·s or lower, and the present invention is more effective.

A fifth aspect of the present invention is, in any one of the first to the fourth aspects, wherein wet film thickness of the coating solution coated on the web is 10 μm or less.

This is because stepped unevenness easily occurs in the ultra-thin film coating of the wet film thickness (moist film thickness) of the coating solution coated on the web of 10 μm or less, and the present invention is more effective.

According to the present invention, even in the case of coating of ultra-thin film (wet film thickness of 10 μm or less) with low viscosity (for example, 0.005 Pa·s or lower), occurrence of stepped unevenness can be effectively suppressed. Accordingly, the present invention is favorable as a coating method on manufacturing high functional thin-layer films for antireflection, glare protection, view angle enlargement and the like which are used for liquid crystal displays and the like.

DETAILED DESCRIPTION OF THE PREFERRED EMBODIMENTS

A preferred embodiment of a coating method of a coating solution according to the present invention will be described with reference to the attached drawings hereinafter.

Figure 1:
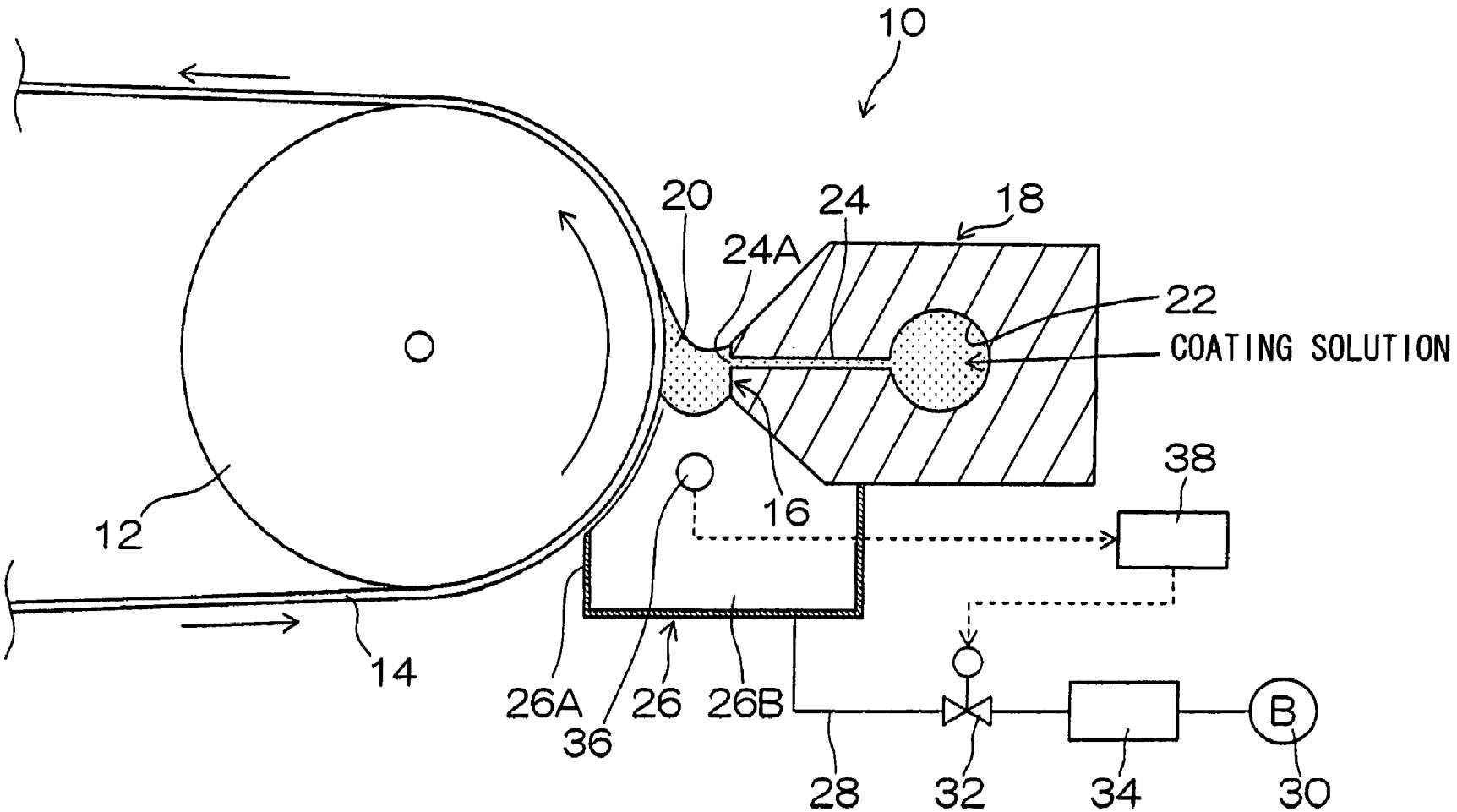
FIG. 1 is a block diagram showing an example of a slot die coater which carries out a coating method of a coating solution of the present invention.
Figure 2:
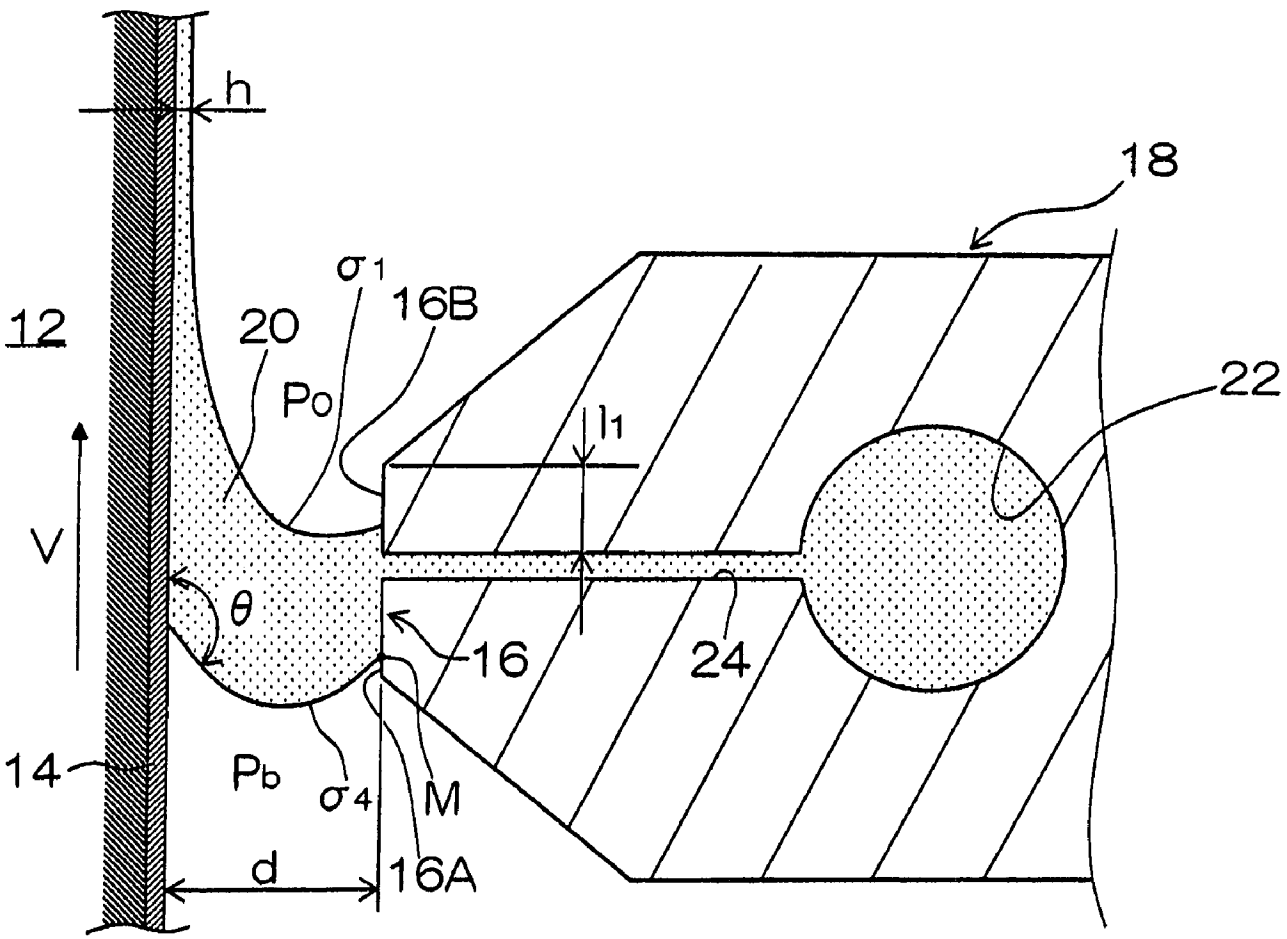
FIG. 2 is an enlarged view of a bead portion in the slot die coater.

FIG. 1 is a block diagram of a slot die coater for carrying out a coating method of a coating solution of the present invention, and FIG. 2 is an enlarged view of a bead portion.

As shown in FIGS. 1 and 2, a slot die coater 10 forms a bead 20 by discharging a coating solution from a slot tip end of a slot die 18 of which lip land 16 is disposed close to a surface of a web 14 which continuously travels while being supported by a backup roller 12 and cross-linking the coating solution between the slot tip end and the web 14 to form a bead 20 and coats the coating solution onto the surface of the web 14 while decompressing a web upstream side of the bead 20.

A manifold 22 and a slot 24 are formed inside the slot die 18. The manifold 22 is a reservoir part which allows the coating solution supplied to the slot die 18 to expansively flow in a web width direction (coating width direction), and its section may be substantially circular, or semicircular, or further, may be a rectangle such as a trapezoid. The coating solution may be supplied to the manifold 22 from one end side of the manifold 22, or may be supplied from a central part of the manifold 22, or a plug for preventing the coating solution from leaking out may be provided at both end portions of the manifold 22, or the solution may be supplied from one end of the manifold 22, a part of solution may be extracted from the other end and may be circulated to the one end again.

The slot 24 is a narrow flow passage for the coating solution, which leads to a slot tip end from the manifold 22, and a coating width restricting plate for restricting the coating width is generally inserted in both end portions of the slot 24. A tip end portion of the slot die 18 where an opening part 24A of the slot 24 is located is formed into a taper shape, and a flat portion called the lip land 16 is formed at its tip end. Here, the lip land at an upstream side in the web traveling direction (lower sides in FIGS. 1 and 2) with respect to the slot 24 is called an upstream side lip land 16A, and the lip land at a downstream side (upper sides in FIGS. 1 and 2) is called a downstream side lip land 16B.

Besides, as shown in FIG. 1, a decompression chamber 26 is provided below a tip end portion of the slot die 18. The web upstream side of the bead 20 is decompressed by this. In the case of the lateral slot die coater 10 of this embodiment, the web upstream side of the bead 20 means a lower side of the bead 20, and the web downstream side of the bead 20 means an upper side of the bead. Though not shown, in the case of a vertical downward slot die (a state in which FIG. 1 is turned counterclockwise by 90 degrees), the web upstream side of the bead 20 means a right side of the bead, and the web downstream side of the bead 20 means a left side of the bead. The decompression chamber 26 includes a back plate 26A and a side plate 26B for keeping its operation efficiency, and gaps exist respectively between the back plate 26A and the web 14 and between the side plate 26B and the web 14.

The decompression chamber 26 is connected to a blower 30 via an air pipe 28, and a valve 32, which adjusts a decompression degree in the decompression chamber 26, and a buffer device 34, which decreases pressure variation in the decompression chamber 26, are provided at midpoints of the air pipe 28.

A pressure gauge 36 which measures pressure (negative pressure) in the decompression chamber 26, namely, pressure (negative pressure) at the web upstream side of the bead 20 is provided in the decompression chamber 26, and the pressure (negative pressure) measured with the pressure gauge 36 is inputted into a controller 38. The controller 38 is provided with an arithmetic circuit which performs an arithmetic operation of the following formula.

$$P_{S1}<P_0-P_b\leqq P_{S1}+0.2 \quad (1)$$

$P_{S1}$ in the expression (1) is a coating window lowest limit decompression degree $P_{S1}$ (kPa) at which a seam trouble begins to occur to a coating solution film surface coated on the web 14 due to air, which accompanies the web 14 when the decompression degree $P_b$ (kPa) at the web upstream side of the bead is made smaller, entering a space between the bead 20 and the web 14, and is expressed by the following expression (2). The expression (2) uses the viscocapillary model (see page 401, "COATING" by Converting Technical Institute).

$$P_{S1} = 1.34(\mu v/\sigma_1)^{2/3}(\sigma_1/h) - \frac{\sigma_4(1+\cos\theta)}{d} + \frac{12\mu v l_1\{(d/2)-h\}}{d^3} \quad (2)$$

Here, reference character $P_0$ designates the pressure at the web downstream side of the bead 20, and is normally atmospheric pressure, which is always constant, as shown in FIG. 2. Reference character $P_b$ designates the pressure (negative pressure) at the web upstream side of the bead 20, and the pressure (negative pressure) is the decompression degree $P_0-P_b$ at the web upstream side with respect to the web downstream side of the bead 20 in the above described expression (1).

Reference character h designates a wet film thickness (m) of the coating solution coated on the web 14, d designates a coating gap (m) which is a gap from the lip land which is nearer to the web 14 among the lip lands 16A and 16B, $l_1$ designates a length (m) in the web traveling direction of the downstream side lip land 16B, and θ designates a contact angle of the web 14 and the bead 20. Besides, reference character μ designates viscosity (Pa·s) of the coating solution coated on the web 14, $\sigma_1$ designates a surface tension (N/m) of the bead at the downstream side (the upper sides in FIGS. 1 and 2), and $\sigma_4$ designates a surface tension (N/m) of the bead at the upstream side (the lower sides in FIGS. 1 and 2). Besides, reference character v designates a coating speed (m/sec), namely, the speed at which the web 14 is transferred.

The numerical values of the necessary parameters to arithmetically operate the lower limit decompression degree $P_{S1}$ are measured or set, and inputted into the controller 38. $\sigma_1$ and $\sigma_4$ which designate the surface tensions (N/m) of the bead can be measured by, for example, a surface tension balance BP-D4 made by KYOWA INTERFACE SCIENCE Co., LTD. The controller 38 arithmetically operates the lower limit decompression degree $P_{S1}$ (kPa) based on the expression (2) from the numerical values of the parameters which are inputted, then adjusts the opening degree of the valve 32 so that the decompression degree $P_0-P_b$ (kPa) at the web upstream side with respect to the pressure $P_0$ at the web downstream side of the bead 20 satisfies the above described expression (1) to set $P_b$. By coating the coating solution under the condition of the decompression degree of $P_b$ thus set, stepped unevenness can be effectively suppressed so as to prevent a seam trouble from occurring.

The range of a preferable decompression degree $P_0-P_b$ in the above described expression (1) is the expression (3), and the range of a more preferable decompression degree $P_0-P_b$ is the range of the expression (4).

$$P_{S1}<P_0-P_b\leqq P_{S1}+0.15 \quad (3)$$

$$P_{S1}<P_0-P_b\leqq P_{S1}+0.1 \quad (4)$$

In the above described embodiment, the lower limit decompression degree $P_{S1}$ at which a seam trouble occurs is obtained from the expression of the viscocapillary model, but it may be obtained by a preliminary operation.

Namely, the negative pressure value of the pressure gauge 36 when a seam trouble begins to occur to the coating solution film surface coated on the web 14 when the decompression degree $P_0-P_b$ (kPa) at the web upstream side with respect to the pressure $P_0$ at the web downstream side of the bead 20 is made smaller is grasped by the preliminary operation (including the preliminary test by laboratory equipment or the like), and the negative pressure value at this time is set as the lower limit decompression degree $P_{S1}$ (kPa). It is visually observed whether a seam trouble begins to occur to the coating solution film surface or not. In the full-scale operation, with use of the lower limit decompression degree $P_{S1}$(kPa) obtained in the preliminary operation, the $P_b$ value is set by adjusting the opening degree of the valve 32 so that $P_0-P_b$(kPa) satisfies the above described expression (1), more preferably, the expression (3), and especially preferably, the expression (4). Stepped unevenness can be effectively suppressed so as not to cause a seam trouble by coating the coating solution under the condition of the decompression degree of $P_b$ thus set.

When the decompression degree $P_0-P_b$(kPa) at the web upstream side with respect to the pressure $P_0$ at the web downstream side of the bead 20 is adjust so as to satisfy the above described expression (1), a lower meniscus position M of the bead 20 in contact with the upstream side lip land 16A is located at a midpoint of the upstream side lip land 16A as shown in FIG. 2.

Besides, in order to suppress occurrence of stepped unevenness more, it is preferable that the coating gap d between the lip land 16 and the web 14 satisfies the following expressions (5) and (6).

$$d=(2h/1.34)(\mu v/\sigma_1)^{-2/3}\times\alpha \quad (5)$$

$$0.25\leqq\alpha<1 \quad (6)$$

Here, h, μ, v and $\sigma_1$ are the same as explained in the expression (2), and α is a coefficient and is a cross-linked limiting proportion of the coating gap.

In order to set the coating gap d so as to satisfy the above-described (5) and (6), the coating gap d is calculated by substituting the numerical values of the parameters, which are measured or set to be substituted in the above described expression (2), and the coefficient α in the range of the expression (6) in the expression (5), and thereafter, at least one of the slot die 18 and the backup roller 12 is moved before the coating operation to adjust the coating gap to the calculated coating gap d. The coating operation is started to satisfy the above described expression (1) in this state.

In the above described expression (6), a more preferable range of α is the expression (7), and an especially preferable range is the range of the expression (8).

$$0.50 \leqq \alpha < 1 \quad (7)$$

$$0.70 \leqq \alpha < 1 \quad (8)$$

In the coating method of the present invention, as the coating solution coated on the web 14, an optical compensation sheet coating solution, an antireflection film coating solution, a magnetic coating solution, a photosensitive coating solution, a surface protective, an antistatic, or a lubricating coating solution, or the like can be used, and the coating solution coated on the web 14 is cut into desired length and width after being dried.

As a solvent of the coating solution, various kinds of known solvents, for example, water, various kinds of halogenated hydrocarbons, alcohol, ether, ester, ketone and the like can be solely used, or a plurality of them can be mixed and used.

As the web 14, various kinds of known webs can be used. Various kinds of known plastic films such as polyethylene terephthalate, polyethylene-2,6-naphthalate, cellulose diacetate, cellulose triacetate, cellulose acetate propionate, polyvinyl chloride, polyvinylidene chloride, polycarbonate, polyimide and polyamide, paper, various kinds of laminated paper which are made by coating or laminating α-polyorefins with the number of carbons of 2 to 10 such as polyethylene, polypropylene and ethylene-butene copolymer on paper, a belt-shaped base material of a metal foil of aluminum, copper, tin or the like with a preliminary worked layer formed on its surface, or various kinds of composite materials with these things laminated are included.

EXAMPLE

Examples of the present invention will be described hereinafter, but the present invention is not limited to them.

(Preparation of Coating Solution)

1.7 parts by mass of a photopolymerization initiator (IRGACURE #907, made by CibaGeigy Corporation), and 1.7 parts by mass of reflective silicone (X-22-164B, made by Shin-Etsu Chemical Co. Ltd.) were dissolved in 193 parts by mass of cyclohexane and 623 parts by mass of methyl ethyl ketone. Further, 182 parts by mass of a methyl isobutyl ketone solution of 18.4% by mass of fluorine-containing copolymer shown in the following (chemical formula 1) was added and agitated, which, thereafter was filtered with a filter of polypropylene (PPE-03) of a pore size of 3 μm, and thereby the coating solution was prepared. The viscosity of the coating solution was 1.0 cP, and the surface tension was 23.0 dyne/cm (0.023. N/m).

[Chemical Formula 1]

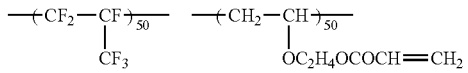

(Creation of Coating Film)

By using the slot die 18 of the length $l_1$ of the downstream side lip land of 50 μm, the above described prepared coating solution was coated on the web 14 of the cellulose triacetate film of thickness of 80 μm (trade name: TAC-TD80U, made by Fuji Photo Film CO. LTD.) to be 3.5 μm in wet film thickness. After the coated coating film was dried at 100° C., the coating film was irradiated with ultraviolet rays to be hardened. The refractive index of the coating film thus created was 1.43, and the average film thickness was 86 nm.

The test was made to determine how the occurrence of the stepped unevenness to the coating solution film surface coated on the web 14 changed in the case where the decompression degree $P_0-P_b$ (kPa) at the web upstream side with respect to the web downstream side of the bead 20 satisfied the range of $P_{S1}<P_0-P_b \leqq P_{S1}+0.2$ and in the case where it did not satisfy the range.

As for the evaluation of the test result, the film thickness distribution in the web traveling direction, namely, the degree of the stepped unevenness was measured, and the stepped unevenness level of an extremely good film surface state with substantially no film thickness distribution was evaluated as A, the stepped unevenness level of a favorable film surface state with a small degree of film thickness distribution was evaluated as B, the stepped unevenness level of a film surface state with the degree of the film thickness distribution having no problem as a coated product was evaluated as C, and the stepped unevenness level of the film surface state with a large degree of the film thickness distribution having a problem as a coated product was evaluated as D.

The result is shown in Table 1. The tests were performed in the case of the coating speed v of 20 m/min and in the case of the coating speed v of 40 m/min, the coating gap d in the case of the coating speed v of 20 m/min was set at 80 μm, and the coating gap d in the case of the coating speed v of 40 m/min was set at 50 μm. In Table 1, "difference from the coating window lower limit decompression degree" means the difference between the decompression degree $P_0-P_b$ (kPa) and the coating window lower limit decompression degree $P_{S1}$ (kPa).

TABLE 1

| No. | coating speed (m/min) | coating gap d(μm) | decompression degree (kPa) Po − Pb | coating window lower limit decompression degree Ps1 (kPa) | difference from coating window lower limit decompression degree (kPa) | web traveling direction film thickness distribution (%) | stepped unevenness level (sensory evaluation) |
|---|---|---|---|---|---|---|---|
| 1 | 20 | 80 | 0.45 | 0.45 | 0 | — | —(several seams) |
| 2 | 20 | 80 | 0.50 | 0.45 | 0.05 | 0.8 | A |
| 3 | 20 | 80 | 0.55 | 0.45 | 0.10 | 1.2 | B |
| 4 | 20 | 80 | 0.60 | 0.45 | 0.15 | 1.7 | B-C |
| 5 | 20 | 80 | 0.65 | 0.45 | 0.20 | 2.2 | C |
| 6 | 20 | 80 | 0.70 | 0.45 | 0.25 | 4.0 | D |

TABLE 1-continued

| No. | coating speed (m/min) | coating gap d(μm) | decompression degree (kPa) Po − Pb | coating window lower limit decompression degree Ps1 (kPa) | difference from coating window lower limit decompression degree (kPa) | web traveling direction film thickness distribution (%) | stepped unevenness level (sensory evaluation) |
|---|---|---|---|---|---|---|---|
| 7 | 40 | 50 | 0.80 | 0.80 | 0 | — | —(several seams) |
| 8 | 40 | 50 | 0.85 | 0.80 | 0.05 | 0.8 | A |
| 9 | 40 | 50 | 0.90 | 0.80 | 0.10 | 1.2 | B |
| 10 | 40 | 50 | 0.95 | 0.80 | 0.15 | 1.7 | B-C |
| 11 | 40 | 50 | 1.00 | 0.80 | 0.20 | 2.2 | C |
| 12 | 40 | 50 | 1.15 | 0.80 | 0.25 | 4.0 | D |

As is known from the result of Table 1, tests No. 2 to No. 5 and tests No. 8 to No. 11 each with the decompression degree $P_0-P_b$ (kPa) at the web upstream side with respect to the web downstream side of the bead 20 satisfying the range of $P_{S1}<P_0-P_b\leqq P_{S1}+0.2$ were in the range of A to C, and have the stepped unevenness levels which pass as the coated products. Especially in the case where the decompression degree was made extremely small with the decompression degree $P_0-P_b$ (kPa) being 0.05 (kPa), the film thickness distribution in the web traveling direction was 0.8%, which was substantially none, and the extremely good film surface state was obtained.

On the other hand, in tests No. 1 and No. 7 where each of the decompression degrees $P_0-P_b$ (kPa) corresponds to the coating window lower limit decompression degree $P_{S1}$ (kPa), several seam troubles occurred, which were not acceptable as the coated products. Tests No. 6 and No. 12 where the decompression degrees $P_0-P_b$ (kPa) exceed $P_{S1}+0.2$ had the large film thickness distributions in the web traveling direction of 4.0%, and were evaluated as D in the stepped unevenness level.

From the test results, $P_b$ was set by adjusting the opening degree of the valve 32 so that the decompression degree $P_0-P_b$ (kPa) satisfies the range of $P_{S1}<P_0-P_b\leqq P_{S1}+0.2$, and the coating solution was coated under the decompression degree condition of the set $P_b$, whereby, the stepped unevenness was able to be effectively suppressed so as not to cause a seam trouble.

Example 2

In the example 2, the test was made to determine how the occurrence of the stepped unevenness to the coating solution film surface coated on the web 14 changed in the case where the coating gap d satisfied the following equation $d=(2h/1.34)(\mu v/\sigma_1)^{-2/3}\times\alpha$, and $0.25\leqq\alpha<1$ and in the case where it did not satisfy them. The test was made with the coating speed v of 30 m/min and the difference from the coating window lower limit decompression degree fixed at 0.20 (kPa). The test result was shown in Table 2 and the evaluation method of the test result was the same as the example 1.

TABLE 2

| No. | coating speed (m/min) | difference from coating window lower limit decompression degree (kPa) | cross-linked limiting proportion of coating gap α | web traveling direction film thickness distribution (%) | stepped unevenness level |
|---|---|---|---|---|---|
| 1 | 30 | 0.20 | 0.15 | 3.0 | D |
| 2 | 30 | 0.20 | 0.25 | 2.0 | C |
| 3 | 30 | 0.20 | 0.50 | 1.2 | B |
| 4 | 30 | 0.20 | 0.70 | 0.8 | A |

As is known from the result in Table 2, the tests No. 2 to 4 where the cross-linked limiting proportions α of the coating gaps satisfied $0.25\leqq\alpha<1$ had the stepped unevenness levels in the range of C to A and passed as the coated products, while in the case where the cross-linked limiting proportion α was 0.15 and was less than the lower limit of $0.25\leqq\alpha<1$ the stepped unevenness level was unacceptable. As the cross-linked limiting proportion α approached the upper limit of $0.25\leqq\alpha<1$, the stepped uneveness level became better. As a result of this, in order to suppress occurrence of the stepped unevenness more, it is preferable that the coating gap d of the lip land 16 and the web 14 satisfies the following expression $d=(2h/1.34)(\mu v/\sigma_1)^{-2/3}\times\alpha$, and $0.25\leqq\alpha<1$.

What is claimed is:

1. A coating method for discharging a coating solution from a slot tip end of a slot die, to which a lip land is closely disposed, to a web surface which continuously travels while being supported by a backup roller to form a bead between the slot tip end and the web, and coating the coating solution on the web surface while decompressing a web upstream side of the bead, comprising the steps of:

setting $P_b$ so that a decompression degree $P_0-P_b$ (kPa) at the web upstream side with respect to a web downstream side of the bead satisfies the following formula:

$$P_{S1}<P_0-P_b\leqq P_{S1}+0.2$$

where $$P_{S1}=1.34(\mu v/\sigma_1)^{2/3}(\sigma_1/h)-\frac{\sigma_4(1+\cos\theta)}{d}+\frac{12\mu v l_1\{(d/2)-h\}}{d^3}$$

$P_0$: pressure at the web downstream side of the bead $P_b$: pressure at the web upstream side of the bead μ: viscosity of the coating solution (Pa·s)

v: coating speed (m/min)

$\sigma_1$: surface tension of a downstream side bead (N/m)

$\sigma_4$: surface tension of an upstream side bead (N/m)

h: wet film thickness of the coating solution coated on the web (m)

d: a coating gap between the lip land and the web (m)

$l_1$: length in a web traveling direction of a downstream side lip land (m), and θ: a contact angle of the web and the bead; and performing coating while suppressing a stepped unevenness of the film thickness of the coating solution, wherein the viscosity of the coating solution (μ) is 0.005 Pa·s or lower, wherein the wet film thickness of the coating solution coated on the web (h) is 10 μm or less, and wherein a coating gap d of the lip land and the web is set so as to satisfy the following formula:

$$d=(2h/1.34)(\mu v/\sigma_1)^{-2/3}\times\alpha$$

$$0.25\leqq\alpha<1.$$

2. A coating method for discharging a coating solution from a slot tip end of a slot die, to which a lip land is closely disposed, to a web surface which continuously travels while being supported by a backup roller to form a bead between the slot tip end and the web, and coating the coating solution on the web surface while decompressing a web upstream side of the bead, comprising the steps of:

firstly obtaining a lower limit decompression degree $P_{S1}$ (kPa) at which a seam trouble begins to occur to a coating solution film surface coated on the web when the decompression degree $P_b$ (kPa) at the web upstream side of the bead is made smaller by a preliminary operation;

after said obtaining step, setting $P_b$ so that a decompression degree $P_0-P_b$ (kPa) at the web upstream side with respect to a web downstream side of the bead satisfies the following formula in a full-scale operation:

$$P_{S1}<P_0-P_b\leqq P_{S1}+0.2$$

where $P_0$: pressure at the web downstream side of the bead, and $P_b$: pressure at the web upstream side of the bead; and after said setting step, performing coating, wherein a viscosity of the coating solution (μ) is 0.005 Pa·s or lower, wherein a wet film thickness of the coating solution coated on the web (h) is 10 μm or less, wherein a stepped unevenness of the film thickness of the coating solution is suppressed during said coating step, and wherein a coating gap d of the lip land and the web is set so as to satisfy the following formula:

$$d=(2h/1.34)(\mu v/\sigma_1)^{-2/3}\times\alpha$$

$$0.25\leqq\alpha<1.$$

* * * * *